US005599196A

United States Patent [19]

Powell et al.

[11] Patent Number: 5,599,196

[45] Date of Patent: Feb. 4, 1997

[54] ELECTRICAL PLUG SAFETY COVER

[76] Inventors: Patti J. Powell; Jack N. Powell, both of 170 Blooming Grove Rd., Hanover, Pa. 17331

[21] Appl. No.: 432,608

[22] Filed: May 1, 1995

[51] Int. Cl.[6] ..... H01R 13/44

[52] U.S. Cl. ..... 439/141; 439/140

[58] Field of Search ..... 439/136, 140, 439/141

[56] References Cited

U.S. PATENT DOCUMENTS

| | | | |
|---|---|---|---|
| 2,082,986 | 6/1937 | Staley . | |
| 2,396,901 | 3/1946 | Tiffany . | |
| 2,423,250 | 7/1947 | Modrey . | |
| 2,458,153 | 11/1949 | Festge . | |
| 2,759,160 | 8/1956 | Kelley . | |
| 3,147,055 | 9/1964 | Rubens . | |
| 3,167,373 | 1/1965 | Kostich . | |
| 3,258,732 | 6/1966 | Martin . | |
| 3,361,320 | 1/1968 | Eckert . | |
| 3,513,435 | 5/1970 | Degaetano . | |
| 3,575,684 | 4/1971 | McIntyre . | |
| 3,629,790 | 12/1971 | McSherry, Jr. | 439/140 |
| 3,740,694 | 6/1973 | Fisher . | |
| 3,754,205 | 8/1973 | Lenkey . | |
| 3,763,457 | 10/1973 | Whippo . | |
| 3,839,697 | 10/1974 | Obert . | |
| 4,305,634 | 12/1981 | Lewis . | |
| 4,340,267 | 7/1982 | Nukaga . | |
| 4,391,481 | 7/1983 | Golden . | |
| 4,445,739 | 5/1984 | Wooten . | |
| 4,810,199 | 3/1989 | Kar | 439/141 |
| 4,820,176 | 4/1989 | Niikura | 439/152 |
| 5,030,119 | 7/1991 | Lowe | 439/141 |
| 5,046,961 | 9/1991 | Hoffman | 439/141 |
| 5,252,082 | 10/1993 | Hsieh et al. | 439/141 |
| 5,423,689 | 6/1995 | Valentino | 439/140 |

FOREIGN PATENT DOCUMENTS

| | | | |
|---|---|---|---|
| 2377714 | 9/1978 | France | 439/140 |
| 672031 | 10/1964 | Italy | 439/140 |
| 2059181 | 4/1981 | United Kingdom | 439/140 |

*Primary Examiner*—Gary E. Elkins

[57] ABSTRACT

A nonconductive electrical plug enclosure having a retractable sheath which retracts into a body as the electrical plug safety cover is plugged into a receptacle and extends out when unplugged. The body houses an electrical plug and has openings through which the plug's prongs may protrude. A cap is secured to the body and securely holds the electrical plug in the body.

8 Claims, 5 Drawing Sheets

ELECTRICAL PLUG SAFETY COVER

BACKGROUND—CROSS REFERENCES TO RELATED APPLICATIONS

No other applications are anticipated or have been submitted by us.

1. Background—Field of Invention

The present Electrical Plug Safety Cover relates generally to electrical plugs, and more particularly, to an attachable electrical plug safety cover adapted to prevent inadvertent exposure to the plug prongs as they are inserted into an electrical outlet to thereby protect the user against possible danger of electrical shock.

2. Background—Discussion of Prior Art

Typical electrical plugs include a plurality of electrically conductive prongs extending outward from the body for connecting to or plugging into a convenience outlet or like receptacle. If the electrical plug is not fully plugged in the prongs are partially exposed and may be energized. This produces a situation where a child or other person may couple the energized prongs by means of an electrically conductive material or touch the prongs simultaneously and induce an electrical shock. An electrical shock hazard also exists if a similar coupling or touching were to occur during the insertion of the electrical plug prongs into a convenience outlet or like receptacle.

In order to solve the problems, people have developed several kinds of safety plugs, prong covers and protective shields.

Examples of various safety plugs are disclosed in the following U.S. Pat. No. 2,082,986 to Staley in 1937; U.S. Pat. No. 2,396,901 to Tiffany in 1946; U.S. Pat. No. 2,423,250 to Modrey in 1947; U.S. Pat. No. 3,167,373 to Kostich in 1965; U.S. Pat. No. 3,513,435 to Degaetano in 1970; U.S. Pat. No. 3,575,684 to Mcintyre in 1971; U.S. Pat. No. 3,754,205 to Lenkey in 1973; U.S. Pat. No. 3,839,697 to Obert in 1974; U.S. Pat. No. 4,340,267 to Nukaga in 1982; U.S. Pat. No. 4,445,739 to Wooten in 1984; U.S. Pat. No. 4,820,176 to Niikura in 1989; U.S. Pat. No. 5,030,119 to Lowe in 1991; U.S. Pat. No. 5,046,961 to Hoffman in 1991; and U.S. Pat. No. 5,252,082 to Hsieh et al. in 1993. All of these share several common features. A retractable prong cover(s) either retract into an outer casing or retract along the exterior of the outer casing. Retraction along the exterior of the outer casing can be interfered with by the operator's grasp of the electrical plug during insertion into a convenience outlet or like receptacle. Most embodiments show the safety plugs connected directly with an electrical cord by mechanical means. Connection of the safety plug in this manner to an existing electrical plug and cord would require cutting off the existing one-piece standard electrical plug from the electrical cord, and reconnecting the electrical cord wires to the safety plug in a manner which is not usually as strong as a standard one-piece molded electrical plug nor as resistant to becoming disconnected from the safety plug if the safety plug is unplugged by pulling on the electrical cord. Other embodiments of the safety plugs show them functioning in a manner similar to an adapter. A standard electrical plug is inserted into the back of the safety plug adapter and the combined assembly is plugged into a convenience outlet or like receptacle. The electrical plug can become partially unplugged from the safety plug adapter and present the same electrical shock hazard that would be present if the safety plug adapter was not attached at all.

Examples or various prong covers are disclosed in the following U.S. Pat. No. 3,147,055 to Rubens in 1964; and U.S. Pat. No. 3,631,320 to Eckert in 1971. In Rubens the cover is held onto the prongs by friction. Over a period of time as material creep and failure of material elasticity occurs, this frictional connection will fail resulting in the prong cover becoming separated from an unplugged electrical plug. In Eckert a base plate which the prong covers are secured to is shown fitting into a recess on the electrical plug's face. Modern, one-piece, molded electrical plugs have no such recess.

Examples of various protective shields are disclosed in the following U.S. Pat. No. 2,458,153 to Festge in 1949; U.S. Pat. No. 2,759,160 to Kelly in 1956; U.S. Pat. No. 3,258,732 to Martin in 1966; U.S. Pat. No. 3,740,694 to Fisher in 1973; U.S. Pat. No. 3,763,457 to Whippo in 1973; U.S. Pat. No. 4,305,634 to Lewis in 1981; U.S. Pat. No. 4,391,481 to Golden in 1983; and U.S. Pat. No. 4,810,199 to Kar in 1989. All of these, except for Lewis, share a couple of features. A resilient, flexible shroud is frictionally secured either to the electrical cord, as in Golden; to the electrical plug body, as in Festge, Kelly, and Martin; or to the prongs, as in Fisher, Whippo, and Kar.

Modern one-piece molded electrical plugs usually have a flange on the prong face which is several times larger than the attached electrical cord. This flange makes it virtually impossible to connect a shroud secured by friction to the electrical cord unless one disconnects the electrical cord from its appliance and slides the shroud down the electrical cord to the electrical plug. Such an assembly operation would require additional tools and a specialized knowledge of the appliance's inner electrical connection points.

Shrouds secured by friction to the electrical plug body require different sizes for the different sized two-prong and three-prong electrical plugs currently manufactured. Once again, the electrical plug flange makes slipping the shroud onto the electrical plug body difficult.

Shrouds secured by friction to the electrical plug prongs require the flexible shroud material to either bunch-up between the electrical plug face and the receptacle, flare out from the electrical plug during insertion which produces a fairly strong unplugging force to be exerted by the shroud, or requires the shroud to roll back around the electrical plug body where it interferes with the operator's grip on the electrical plug or allows it to get hung up on the flange and thus not cover the prongs when the electrical plug is unplugged.

OBJECTS AND ADVANTAGES

Accordingly, several objects and advantages of our Electrical Plug Safety Cover are:

(a) to provide the ability to reduce the possibility of an electrical shock hazard by making coupling or touching an electrical plug's prongs more difficult when the electrical plug is partially inserted into a convenience outlet or like receptacle;

(b) to provide a retractable prong sheath that is not interfered with by an operator's grip on the assembly during insertion and unplugging activities;

(c) to provide a means to secure the assembly to an existing electrical plug in a way that does not require specialized tools, knowledge of electrical wiring techniques, and destruction of the electrical plug and cord's one-piece sealed integrity;

(d) to provide a means for the assembly to be removed from the electrical plug and reinstalled on another electrical plug without causing any damage to the first electrical plug and to be used repeatably; and (e) to provide an assembly which will accommodate a variety of electrical plug and prong configurations.

Still further objects and advantages will become apparent from a consideration of the ensuing description and drawings.

DESCRIPTION OF DRAWING FIGURES

Figure 1:
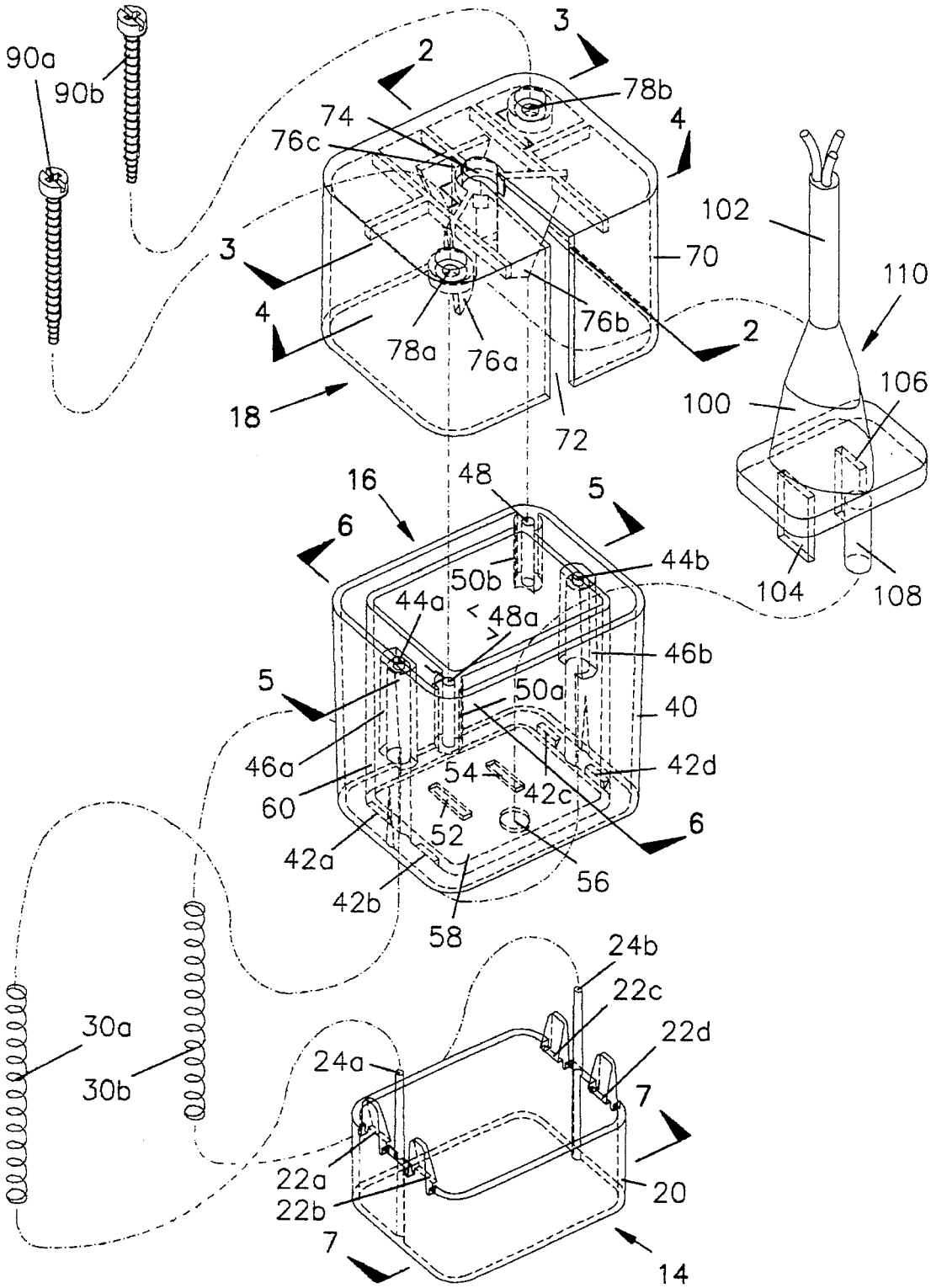
FIG. 1 is an exploded view of Electrical Plug Safety Cover with an electrical plug.

| Reference Numerals | |
|---|---|
| Reference Numeral | Description |
| 14 | Retractable Sheath |
| 16 | Body |
| 18 | Cap |
| 20 | Middle Sheath |
| 22a, 22b, 22c, 22d | Middle Sheath Retaining Ledges |
| 24a, 24b | Spring Supports |
| 30a, 30b | Springs |
| 40 | Outer Sheath |
| 42a, 42b, 42c, 42d | Retractable Sheath Retaining Ledges |
| 44a, 44b | Support Guide Openings |
| 46a, 46b | Support Guides |
| 48a, 48b | Cap Screw Receiver Openings |
| 50a, 50b | Cap Screw Receivers |
| 52 | Large Polarized Prong Receiver |
| 54 | Small Polarized Prong Receiver |
| 56 | Ground Prong Receiver |
| 58 | Body Face |
| 60 | Inner Sheath |
| 70 | Cap Sheath |
| 72 | Cord Insertion Slot |
| 74 | Cord Retention Area |
| 76a, 76b, 76c | Cord Support Ribs |
| 78a, 78b | Cap Screw Openings |

-continued

| Reference Numerals | |
|---|---|
| Reference Numeral | Description |
| 90a, 90b | Cap Screws |
| 100 | Electrical Plug Body |
| 102 | Electrical Cord |
| 104 | Large Polarized Prong |
| 106 | Small Polarized Prong |
| 108 | Ground Prong |
| 110 | Electrical Plug |

SUMMARY OF INVENTION

Electrical Plug Safety Cover is a device who's purpose is to limit the exposure to electrical shock from the electrical plug prongs during their insertion into and extraction from a convenience outlet or like receptacle. The device also limits the exposure to electrical shock from the electrical plug prongs while they are only partially inserted into a convenience outlet or like receptacle.

DESCRIPTION OF INVENTION

A typical embodiment of Electrical Plug Safety Cover is illustrated in FIG. 1 (exploded view). Retractable Sheath 14, Body 16 and Cap 18 are manufactured out of a non-conductive, rigid material. Springs 30*a*, 30*b* are helical elements manufactured out of an appropriate material to produce an element of sufficient compressive strength to bias Retractable Sheath in an extended position when Electrical Plug Safety Cover is not connected to a convenience outlet or like receptacle. The compressive strength of Springs in not so great as to cause Retractable Sheath to prematurely extend while Electrical Plug Safety Cover is connected to a convenience outlet or like receptacle and disconnect Electrical Plug Safety Cover. Cap Screws 90*a*, 90*b* are self tapping screws utilized to secure Cap to Body and in that process immobilize Electrical Plug Body 100 within Body.

Figure 2:
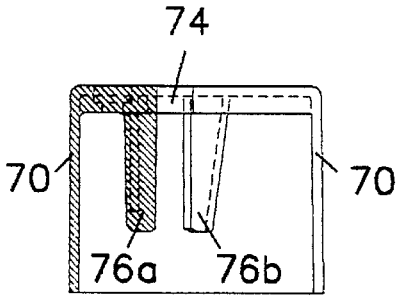
FIG. 2 is a view in detail of Cap indicated by the section lines 2—2 in FIG. 1.
Figure 3:
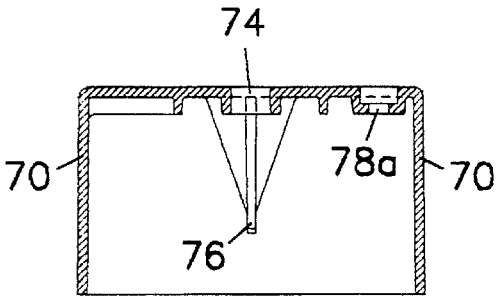
FIG. 3 is a view in detail of Cap indicated by the section lines 3—3 in FIG. 1.
Figure 4:
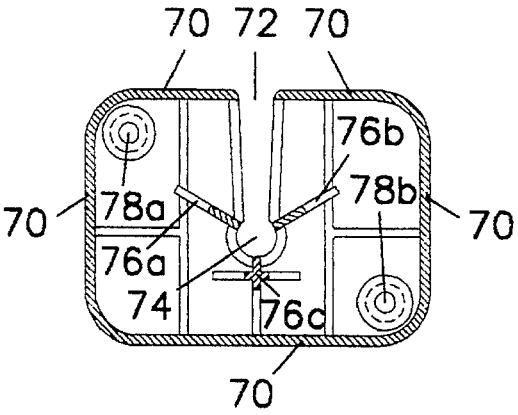
FIG. 4 is a view in detail of Cap indicated by the section lines 4—4 in FIG. 1.

FIGS. 2, 3 and 4 more clearly shows the various details of Cap. Cord Insertion Slot 72 is an open slot which provides a pathway for Electrical Cord 102 to use to obtain entry into Cord Retention Area 74. Cap Screws fit into countersunk Cap Screw Openings 78*a*, 78*b*. Cord Support Ribs 76*a*, 76*b*, 76*c* are rigid ribs used to engage and hold down Electrical Plug Body as Cap Screws are screwed into Body to allow Electrical Plug Safety Cover to be used on another Electrical Plug 110.

Figure 5:
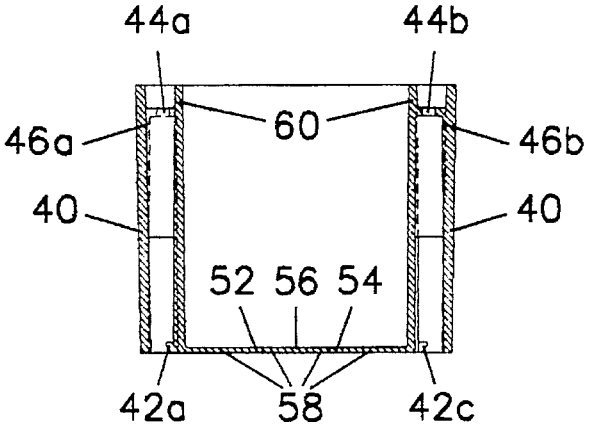
FIG. 5 is a view in detail of Body indicated by the section lines 5—5 in FIG. 1.
Figure 6:
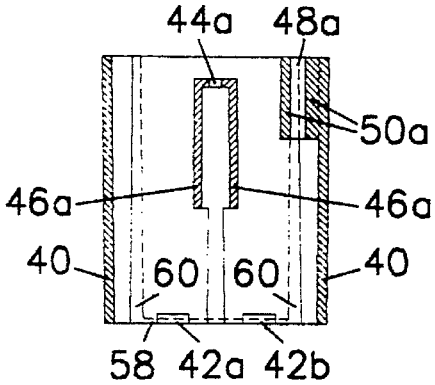
FIG. 6 is a view in detail of Body indicated by the section lines 6—6 in FIG. 1.

Details of Body are visible in FIGS. 5 and 6. Large Polarized Prong 104, Small Polarized Prong 106 and Ground Prong 108 of Electrical Plug fit into Body's Large Polarized Prong Receiver 52, Small Polarized Prong Receiver 54 and Ground Prong Receiver 56 openings in Body Face 58. Body Face provides a seating and support area for in inserted Electrical Plug. Inner Sheath 60 provides support for Body Face and isolates Electrical Plug from moving Spring and Retractable Sheath. Cap Screws are secured into Cap Screw Receiver Openings 48*a*, 48*b* in Cap Screw Receivers 50*a*, 50*b* thus securing Cap to Body. Spring Support Guides 46*a*, 46*b* provide lateral support, linear guidance and a housing for Springs during movement of Retractable Sheath. Support Guide Openings 44*a*, 44*b* provide openings for Spring Supports 24*a*, 24*b* to pass through during movement of Retractable Sheath thus allowing Spring seating depth in Spring Support Guide to be adjusted during manufacturing to suit Spring strength without compromising ability of Retractable Sheath to fully retract. Retractable Sheath Retaining Ledges 42*a*, 42*b*, 42*c*, 42*d* engage Middle Sheath Ledges 22*a*, 22*b*, 22*c*, 22*d* respectively, once assembled, to prevent removal of Retractable Sheath from Body. Outer Sheath 40 isolates moving Retractable Sheath and Springs from external interferences.

Figure 7:
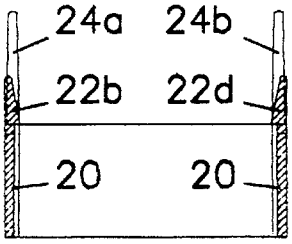
FIG. 7 is a view in detail of Retractable Sheath indicated by the section lines 7—7 in FIG. 1.

FIG. 7 shows details of Retractable Sheath. Middle Sheath 20 provides a barrier around prongs during Electrical Plug Safety Cover's use which reduces the likelihood of coupling or touching energized prongs. Retractable Sheath Ledges help prevent Retractable Sheath from being removed from Body. Spring Supports provide lateral support and linear guidance for springs during movement of Retractable Sheath. Spring Supports are sufficiently long enough to extend into Spring Support Guides while Retractable Sheath is in the extended position. This allows Springs to have continuous support and guidance over the complete length of travel during compression and expansion.

Figure 8:
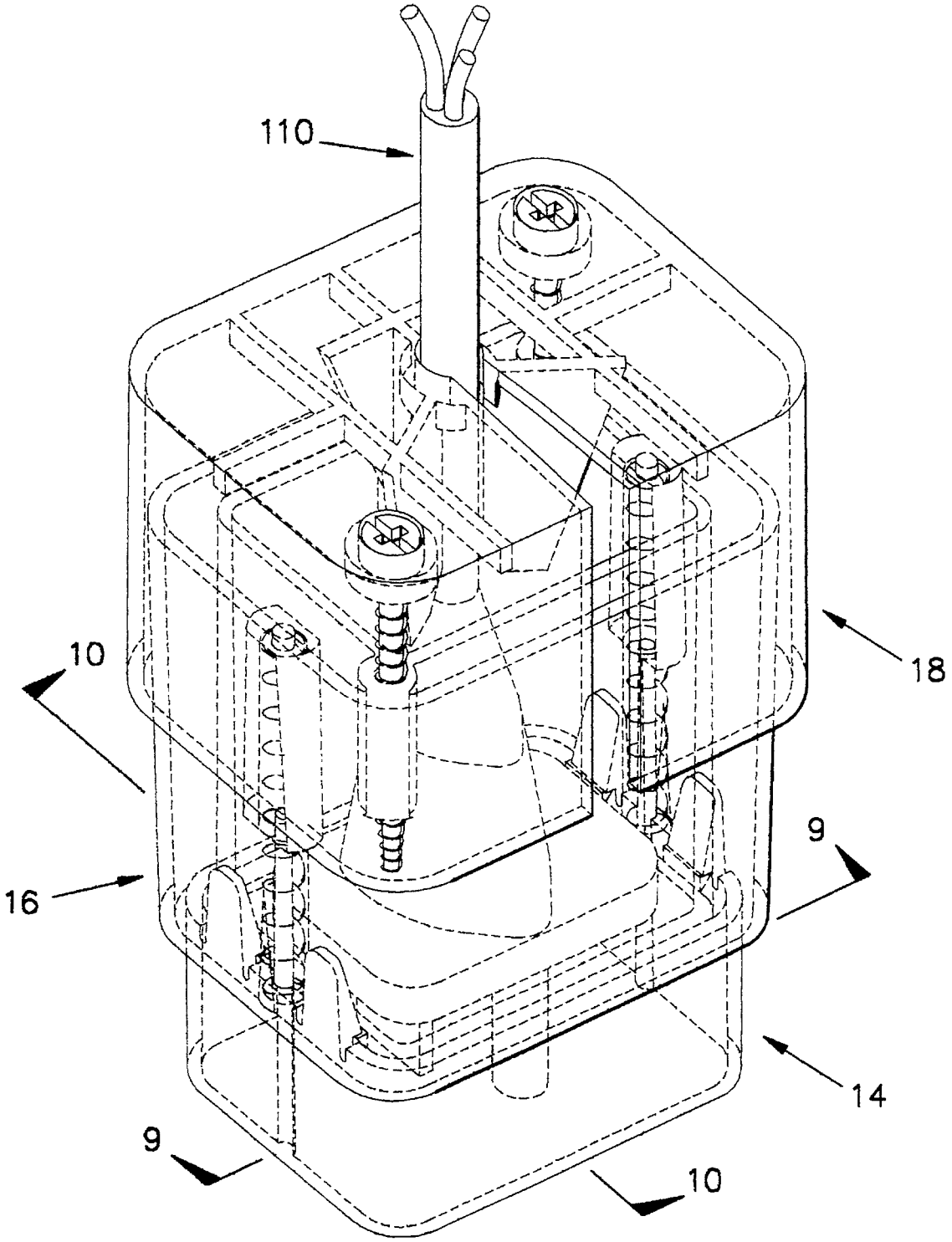
FIG. 8 is a perspective view of Electrical Plug Safety Cover assembled and attached to an electrical plug with Retractable Sheath in the extended position.

FIG. 8 is a perspective view of Electrical Plug Safety Cover which has been assembled and attached to Electrical Plug. Retractable Sheath is shown in the extended position as it would occur when Electrical Plug Safety Cover is not connected to a convenience outlet or like receptacle.

Figure 9:
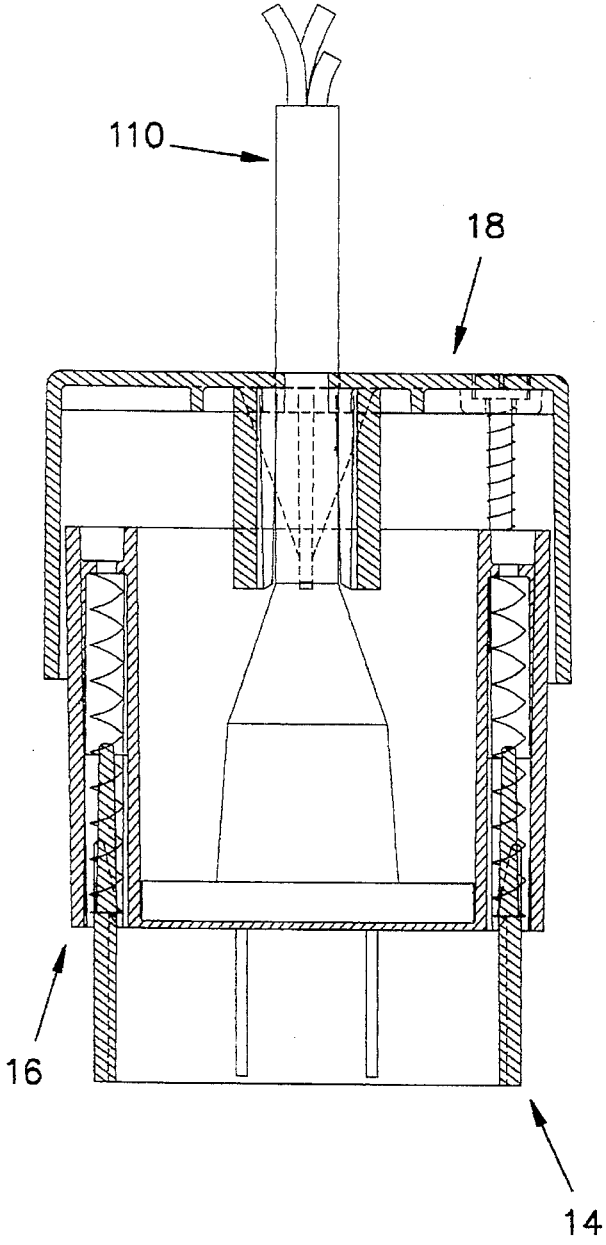
FIG. 9 is a view in detail of Electrical Plug Safety Cover indicated by the section lines 9—9 in FIG. 8.
Figure 10:
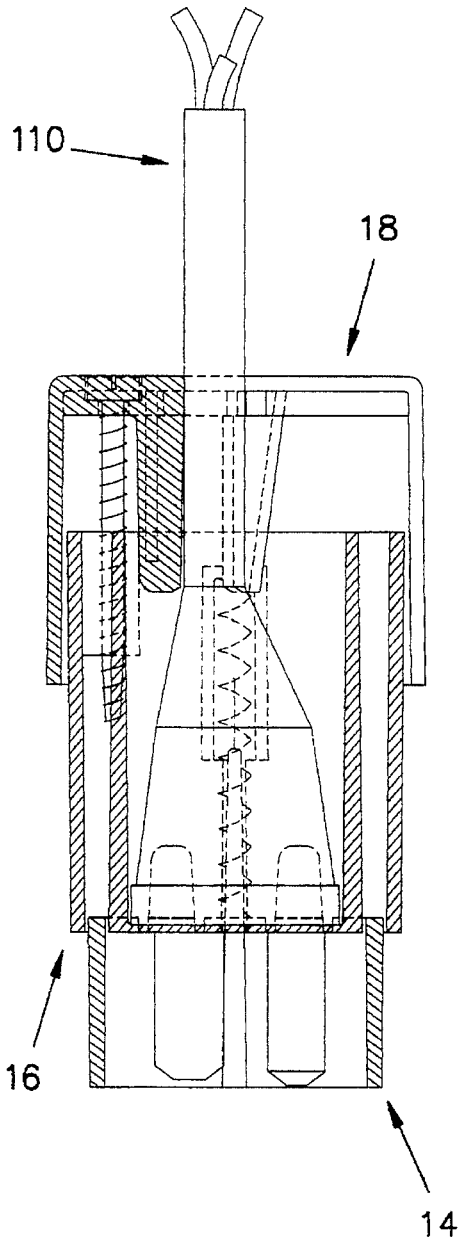
FIG. 10 is a view in detail of Electrical Plug Safety Cover indicated by the section lines 10—10 in FIG. 8.

FIG. 9 and 10 detail the previously described features of Cap, Body and Retractable Sheath in an assembled position with Retractable Sheath extended.

Figure 11:
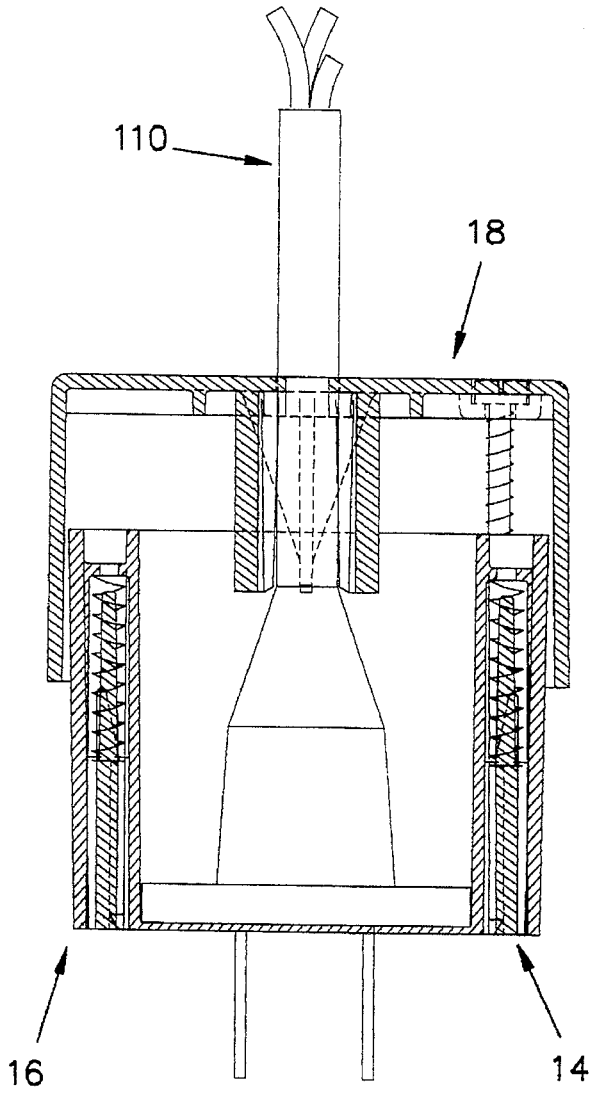
FIG. 11 is a view in detail of Electrical Plug Safety Cover as shown in FIG. 9 except Retractable Sheath is compressed into Body as it would be during insertion into a convenience outlet or like receptacle.
Figure 12:
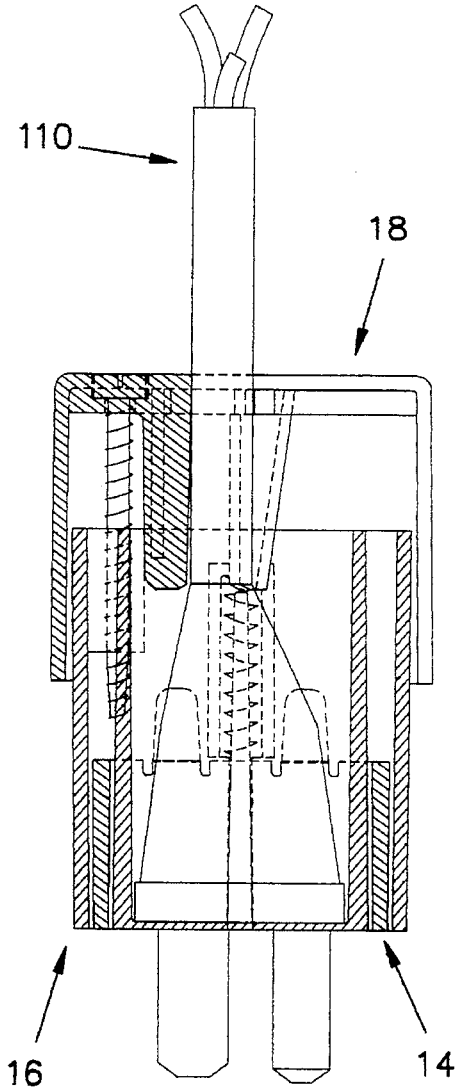
FIG. 12 is a view in detail of Electrical Plug Safety Cover as shown in FIG. 10 except Retractable Sheath is compressed into Body as it would be during insertion into a convenience outlet or like receptacle.

FIG. 11 and 12 detail the previously described features of Cap, Body and Retractable Sheath in an assembled position with Retractable Sheath retracted.

Operation of Invention

The following Steps describe Electrical Plug Safety Cover's assembly and use:

Step 1 Springs 30*a*, 30*b* are placed onto Spring Supports 24*a*, 24*b*.

Step 2 Retractable Sheath 14 is inserted into the space between the Inner Sheath 60 and Outer Sheath 40 such that Spring Supports align with respective Support Guide Openings 44*a*, 44*b* in Support Guides 46*a*, 46*b*. Insertion continues until Middle Sheath Retaining Ledges 22*a*, 22*b*, 22*c*, 22*d* pass respective Retractable Sheath Retaining Ledges 42*a*, 42*b*, 42*c*, 42*d*. A connection between the Body and Retractable Sheath is effected which allows Middle Sheath 20 to slide between Inner Sheath and Outer Sheath.

Step 3 Large Polarized Prong 104, Small Polarized Prong 106 and Ground Prong 108 (if present) of Electrical Plug 110 are inserted through Large Polarized Prong Receiver 52, Small Polarized Prong Receiver 54 and Ground Prong Receiver 56 respectively until Electrical Plug Body 100 comes into contact with Body Face 58.

Step 4 Cap 18 is then attached by sliding Electrical Cord 102 through Cord Insertion Slot 72 into Cord Retention Area 74.

Step 5 Cap is then slid along Electrical Cord toward Electrical Plug Body with Cap Screw Openings 78*a*, 78*b* aligned with Cap Screw Receiver Openings 48*a*, 48*b* in Cap Screw Receivers 50*a*, 50*b*. Sliding motion will continue until Cap Sheath 70 overlaps Outer Sheath, Cord Support Ribs 76*a*, 76*b*, 76*c* enter Inner Sheath, and Cord Support Ribs contact Electrical Plug Body.

Step 6 Cap Screws 90*a*, 90*b* are then inserted into Cap Screw Openings and screwed into Cap Screw Receiver Openings until Cap is securely fastened to Body 16.

Electrical Plug Safety Cover is now ready for use. To insert Electrical Plug Safety Cover into a convenience outlet or other like receptacle (Receiver):

Step 7 Align Large Polarized Prong, Small Polarized Prong and Ground Prong (if applicable) (Prongs) with their appropriate Receiver elements and utilizing a linear movement insert Prongs into Receiver. As the Prongs are inserted Middle Sheath contacts Receiver and begins to recoil into Body while maintaining a seal with Receiver. Seal helps reduce the possibility of inadvertent exposure to and contact with energized Prongs.

To remove Electrical Plug Safety Cover from a Receiver:

Step 8 Grasp Electrical Plug Safety Cover by Body and Cap, and utilizing a linear motion extract Prongs from Receiver. As Prongs are being extracted Springs bias Middle Sheath outward from inside Body to maintain a seal with Receiver.

To remove Electrical Plug Safety Cover from Electrical Plug perform Steps 3 to 6 in reverse order.

To reinstall Electrical Plug Safety Cover onto another Electrical Plug perform Steps 3 to 6 in that order.

Conclusion, Ramifications, and Scope of Invention

The reader will see that Electrical Plug Safety Cover can be used on a wide variety of Electrical Plugs and like connectors which may cause injury to their operator if contact were made with or between prongs or other like extensions. Electrical Plug Safety Cover can easily and conveniently be uninstalled from one Electrical Plug and reinstalled on another Electrical Plug. In addition to Electrical Plug Safety Cover's ability to reduce shock and its ability to be installed on one Electrical Plug, removed and reinstalled on another Electrical Plug, other advantages are:

a Retractable Sheath that is not interfered with by the operator's grip on Electrical Plug Safety Cover.

able to be attached without specialty electrical tools or knowledge.

ability to accept various Electrical Plug prong configurations.

Although the description above contains many specifities, these should not be construed as limiting the scope of Electrical Plug Safety Cover but as merely providing illustrations of some of the presently preferred embodiments of Electrical Plug Safety Cover. For example, Electrical Plug Safety Cover may have different Prong Receiver openings to accommodate different Electrical Plug prong configurations; Cord Insertion Slot may have flaps or other additional Electrical Cord restraining mechanisms; Electrical Plug Safety Cover may be round, rectangular, square, or any other shape as required for its application; Electrical Plug Safety Cover may be clear or colored; Electrical Plug Safety Cover may be used in any application where protection is desirable for an item which is being inserted into a mating receiver, etc.

Thus the scope of Electrical Plug Safety Cover should be determined by the appended claims and their legal equivalents, rather than by the examples given.

We claim:

1. An electrical plug enclosure comprising a body of sufficient size to surround an electrical plug, a cap having a fastening means for joining said cap to said body, securing means for immobilizing said electrical plug within said body, a plurality of biasing elements, a retractable sheath having a guidance means for said sheath and said biasing elements during said sheaths and said biasing elements axial compression into said body and extension from said body, means for said body to retain said sheath at maximum extension.

2. The electrical plug enclosure of claim 1 wherein said cap further includes a plurality of rigid cord support ribs utilized by said securing means to transfer compressive force developed by said fastening means to said surrounded electrical plug.

3. The electrical plug enclosure of claim 1 wherein said body is composed of an electrically insulative, rigid material.

4. The electrical plug enclosure of claim 1 wherein said body further includes a means for allowing a plurality of electrical plug prongs to extend beyond the exterior of said body.

5. The electrical plug enclosure of claim 1 wherein said cap is composed of an electrically insulative, rigid material.

6. The electrical plug enclosure of claim 1 wherein said cap further includes a means for gripping an electrical cord.

7. The electrical plug enclosure of claim 1 wherein said sheath is composed of an electrically insulative, rigid material.

8. The electrical plug enclosure of claim 1 wherein said guidance means further provides axial support to said biasing elements during their axial compression and extension.

* * * * *